US007090024B2

(12) United States Patent
Simpson et al.

(10) Patent No.: US 7,090,024 B2
(45) Date of Patent: Aug. 15, 2006

(54) TUBING ANCHOR

(75) Inventors: Neil Andrew Abercrombie Simpson, Aberdeen (GB); Alexander Craig MacKay, Aberdeen (GB); Graham MacKay, Aberdeen (GB); Duncan James Trinder, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 155 days.

(21) Appl. No.: 10/428,537

(22) Filed: May 2, 2003

(65) Prior Publication Data

US 2003/0205388 A1 Nov. 6, 2003

(30) Foreign Application Priority Data

May 3, 2002 (GB) ..... 0210256

(51) Int. Cl.
*E21B 23/01* (2006.01)

(52) U.S. Cl. ..... 166/382; 166/118; 166/207; 166/242.2; 166/243; 166/384

(58) Field of Classification Search ..... 166/117.6, 166/118, 177.4, 206–208, 242.2, 243, 382, 166/384, 387
See application file for complete search history.

(56) References Cited

U.S. PATENT DOCUMENTS

| | | | | |
|---|---|---|---|---|
| 1,751,090 | A | 3/1930 | Lamoureux | |
| 2,155,973 | A | 4/1939 | Irwine et al. | |
| 2,323,989 | A | 7/1943 | Fulkerson | |
| 2,616,503 | A | 11/1952 | Armentrout | |
| 3,067,819 | A | 12/1962 | Gore | |
| 3,203,483 | A | 8/1965 | Vincent | |
| 3,294,122 | A | 12/1966 | Sharp | |
| 3,353,599 | A | 11/1967 | Swift | |
| 3,437,246 | A | 4/1969 | Clapp | |
| 3,560,117 | A | 2/1971 | Valbjom et al. | |
| 3,863,939 | A | 2/1975 | Sato | |
| 4,012,092 | A * | 3/1977 | Godbey | 439/191 |
| 4,127,168 | A * | 11/1978 | Hanson et al. | 166/123 |
| 4,424,865 | A | 1/1984 | Payton, Jr. | |
| 4,903,993 | A | 2/1990 | Brammer | |
| 5,083,608 | A | 1/1992 | Abdrakhmanov et al. | |
| 5,095,991 | A | 3/1992 | Milberger | |
| 6,098,717 | A | 8/2000 | Bailey et al. | 166/382 |
| 6,112,818 | A | 9/2000 | Campbell | |
| 6,550,539 | B1 * | 4/2003 | Maguire et al. | 166/380 |
| 6,742,606 | B1 | 6/2004 | Metcalfe et al. | |
| 2001/0020532 | A1 | 9/2001 | Baugh et al. | |
| 2003/0188874 | A1 | 10/2003 | Gabrysch et al. | |

FOREIGN PATENT DOCUMENTS

| | | |
|---|---|---|
| DE | 464 931 | 9/1983 |
| GB | 2368866 A | 5/2002 |

(Continued)

OTHER PUBLICATIONS

International Search Report for GB 0210256.4, dated Sep. 10, 2002.

(Continued)

*Primary Examiner*—Zakiya W. Bates
(74) *Attorney, Agent, or Firm*—Patterson & Sheridan LLP

(57) ABSTRACT

A method of anchoring tubing in a bore comprising: providing tubing having a section with outer surface portions defining a tubing profile, and configured to describe an outer diameter less than a first diameter. The tubing is located within a bore having an internal diameter equal to the first diameter and defining a bore profile. The tubing is then reconfigured such that the tubing profile engages with the bore profile, anchoring the tubing within the bore.

73 Claims, 2 Drawing Sheets

FOREIGN PATENT DOCUMENTS

| | | | | |
|---|---|---|---|---|
| RU | 2144128 | C1 | * | 1/2000 |
| SU | 663825 | | * | 5/1979 |
| SU | 989038 | | * | 1/1983 |
| SU | 1745873 | A1 | * | 7/1992 |
| WO | WO 93 25799 | | | 12/1993 |
| WO | WO 00 37766 | | | 6/2000 |
| WO | WO 02 04783 | | | 1/2002 |

OTHER PUBLICATIONS

International Search Report, Application No. GB 03/01881, dated Dec. 16, 2003.
International Search Report, Application No. GB 03/01879, dated Dec. 16, 2003.

* cited by examiner

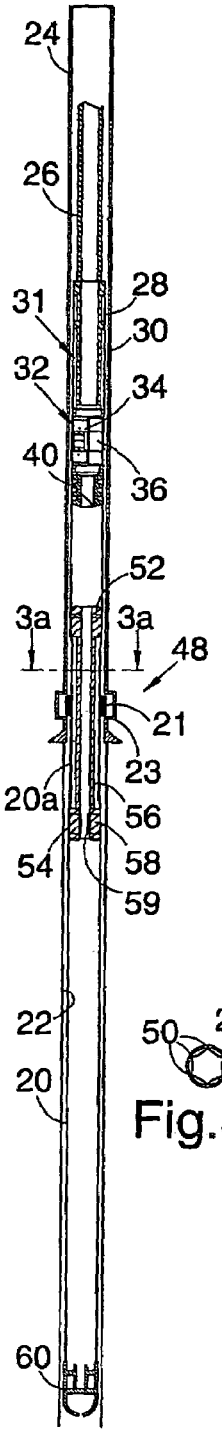
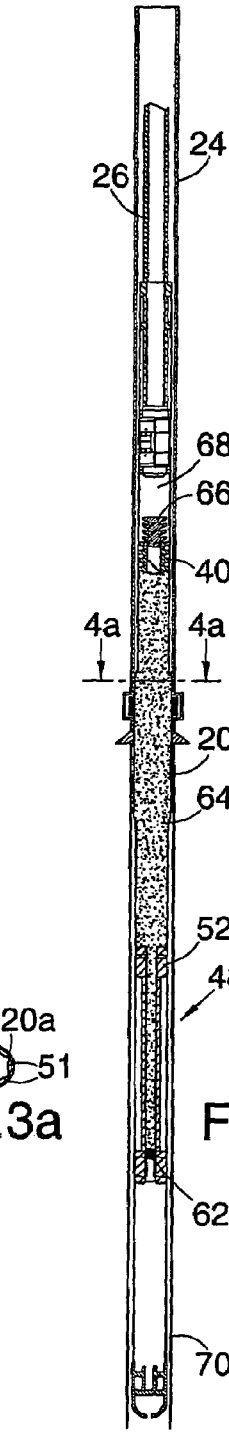
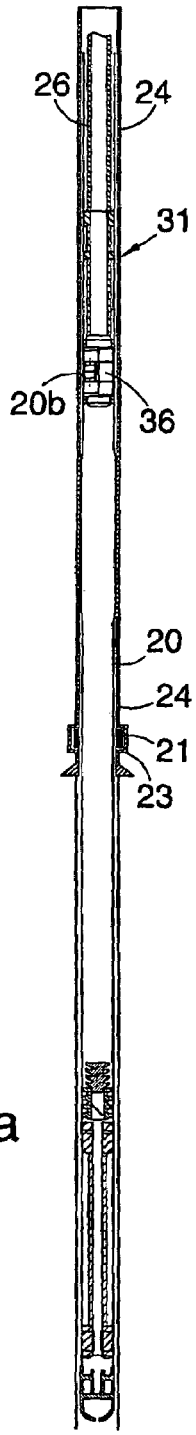
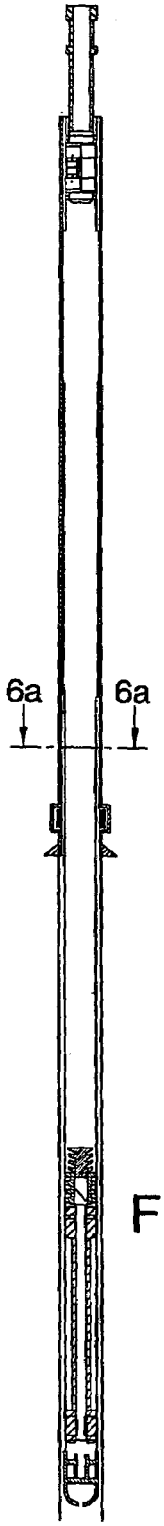
Fig.3a
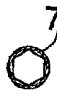
Fig.4a
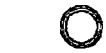
Fig.6a
Fig.3 Fig.4 Fig.5 Fig.6

TUBING ANCHOR

BACKGROUND OF THE INVENTION

A recent development in the oil and gas exploration and production industry has been the adoption of expandable bore-lining tubing. This involves running tubing into an open section of bore and then expanding at least a portion of the tubing to a larger diameter. Typically, the upper end of the tubing will overlap the lower end of existing bore-lining casing or liner. In a number of proposals, the upper end of the tubing is expanded initially to create a tubing hanger which serves to fix the tubing in the bore so that the tubing may be disengaged from the running string used to carry the tubing into the bore. Other operations, such as cementing the tubing, or expanding other portions of the tubing, may then take place.

The present applicant has identified that there are certain difficulties involved in creating the initial anchor, particularly in previously cemented tubing. A number of existing proposals suggest the use of radially extendable members for radially extending circumferentially spaced portions of the tubing, to bring the outer surfaces of these portions into engagement with the surrounding casing. However, in any such deformation of metallic tubing, there is a degree of elastic recovery of the tubing once the deforming force has been removed. Thus, the desired degree of engagement between the tubing and the casing may not be achieved.

FIELD OF THE INVENTION

This invention relates to tubing anchors. In particular the invention relates to an apparatus and method of anchoring one tubing within another, most particularly at a downhole location.

SUMMARY OF THE INVENTION

According to a first aspect of the present invention there is provided a method of anchoring tubing in a bore, the method comprising:

providing tubing having a section having outer surface portions defining a tubing profile, the outer surface portions configured to describe an outer diameter less than a first diameter;

locating the tubing within a bore having an internal diameter equal to the first diameter, and defining a bore profile; and reconfiguring the tubing section such that the tubing profile engages with the bore profile.

Preferably, the tubing profile defines a radially extending surface and the bore profile defines a cooperating radially extending surface. The tubing profile may be a radial projection and the bore profile a radial recess.

Preferably, the tubing profile is defined by a plurality of radial projections and the bore profile a one or more of radial recesses. Alternatively, the tubing profile may be a circumferential rib.

In an alternative embodiment the bore profile may be defined by one or more radial projections and the tubing profile by one or more radial recesses. Conveniently, the bore profile may be a circumferential rib and the tubing profile a circumferential channel.

When the tubing section is reconfigured, the outer surface portions are moved radially outwardly such that the tubing profile may engage with the bore profile, securing the tubing in the bore. Further reconfiguration of the tubing section may bring further parts of the outer surface portions into contact with the bore, which will further assist in securing the tubing in the bore.

The method of the invention thus provides a convenient method of creating a coupling between a tubing and a surrounding bore wall, which coupling may be utilised to fix the tubing relative to the bore, both axially and rotationally, to facilitate subsequent operations, such as further reconfiguration or deformation of the tubing, or cementation of the tubing in the bore. The outer surface portions of the tubing may be circumferentially spaced, and most preferably are regularly spaced around the circumference of the tubing. Alternatively, the outer surface portions may be defined by a substantially continuous arc or segment. The tubing may initially be circular and in this initial form preferably has an outer diameter at least as large as the first diameter. Portions of the initially circular tubing wall may be reconfigured to a generally planar form such that the tubing is then substantially polygonal, most preferably defining a pentagon or hexagon. The tubing may then be further reconfigured such that the planar tubing wall portions become convex, and are located between the outer surface portions, which describe the tubing maximum diameter, which is less than said first diameter. The tubing may then be passed into the bore. Alternatively, one or more indents may be formed in the tubing wall, to create one or more convex wall portions such that the tubing defines an outer diameter less than said first diameter. Of course the tubing may be initially created in this form, if desired.

If a radially outwardly directed force is then applied to the one or more convex wall portions, which will typically describe the tubing section minimum diameter, the outer surface portions are urged radially outwards to assume a configuration in which at least the tubing profile and the bore profile can engage.

The provision of one or more convex wall portions facilitates passage of fluid between the tubing section and the surrounding bore, both before and after reconfiguring the tubing section, and even after the tubing section is restrained in the bore, which may be particularly useful if the first tubing is to be cemented in the bore. If desired, the tubing may subsequently be sealed to the bore wall by, for example, reconfiguring the tubing section to a form corresponding to the bore wall or, most preferably, by configuring another section of the tubing to a form corresponding to the bore wall. Most preferably, sealing the tubing with the bore wall is achieved by expanding a section of the tubing, which section may include a peripheral seal member. Preferably, the expansion is achieved by means of a rotary expander, that is an expander which is rotatable in the tubing and preferably includes at least one rotating member in rolling contact with the tubing inner wall.

The bore may be a drilled or otherwise formed bore, a section of tubing or pipe, or a combination of both. Preferably, the bore is at least partially defined by downhole bore-lining tubing, such as casing or liner. The bore-lining tubing will typically be unexpandable, for example if the bore-lining tubing has been cemented; the method of the present invention allows the tubing to be located in such bore-lining tubing while avoiding the difficulties that are inherent in locating tubing by expansion within an unexpandable larger tubing. However, in other embodiments of the invention the bore-lining tubing may experience a degree of expansion, elastic, inelastic or both.

The radially outwardly directed force is preferably created by passing a tubing expander, which may be of conical or tapered form, through the tubing. Preferably, the tubing expander comprises an expansion cone, and most preferably the expander comprises a seal for sealingly engaging the bore wall, such that fluid pressure may be utilised to drive the expander through the tubing section. The expander may have a first configuration in which fluid may pass through or around the expander, and a second configuration in which the expander creates a barrier to fluid flow through the bore. The second configuration may be achieved by locating a ball or plug in a suitable shoe or profile in the expander. The expander may further be adapted to assume a third configuration in which fluid may again flow through or around the expander. The third configuration may be achieved by rupturing a disc, diaphragm or the like, which may be provided in the plug, or by shearing out a ball or plug shoe.

The tubing may itself serve as a hanger, or may be coupled, by any appropriate means, to a hanger to be set following the reconfiguration of the tubing.

A further length of tubing, which may or may not be expandable, may be coupled to the tubing.

The tubing may include a profile for co-operating with a corresponding profile on a running string to allow the string to support the tubing as the tubing is being run into the bore. Preferably, the profile is provided on an upper portion of the tubing, above a notch in the tubing. The area of tubing including the notch may be subject to expansion utilising a rotary expander, which it has been found results in the tubing shearing or otherwise parting at the notch, allowing the portion of tubing defining the profile to be pulled out of the bore, leaving the remainder of the tubing in the bore.

According to a second aspect of the present invention there is provided apparatus for use in anchoring tubing in a section of a bore having an internal first diameter and defining a bore profile, the apparatus comprising:

tubing including a section with a non-circular wall, the wall having an outer surface portion defining a tubing profile, the wall configured such that the outer surface portion describes an outer diameter less than the first diameter;

means for engaging a running tool for running the tubing into the bore; and a first expander for diametrically expanding the tubing section wall such that the tubing profile engages with the bore profile.

Preferably, the apparatus further comprises a second expander for expanding a section of the tubing into sealing contact with the bore wall.

According to a further aspect of the present invention there is provided a method of anchoring tubing in a bore, the method comprising:

providing tubing having a section with outer surface portions defining a profile, the section configured such that the outer surface portions describe an outer diameter less than a first diameter;

locating the tubing within a bore having an internal surface defining a profile, the bore having an internal diameter corresponding to said first diameter; and reconfiguring said section such that said outer surface portions are biased to describe an outer diameter greater than said first diameter but are restrained to said first diameter by said bore, and such that said tubing profile engages the bore profile.

According to a fourth aspect of the present invention there is provided a method of anchoring tubing in a bore, the bore having an internal first diameter, and defining a bore profile, the method comprising:

providing tubing having a section with outer surface portions defining a tubing profile, the outer surface portions configured to describe an outer diameter greater than the first diameter, at least one of the tubing and the bore comprising an elastically deformable material; and axially translating the tubing relative to the bore to locate the tubing within the bore such that the tubing profile engages with the bore profile.

Preferably, the tubing comprises elastically deformable material. Alternatively, the bore comprises elastically deformable material.

The method of the invention thus provides a convenient method of creating a coupling between a tubing and a surrounding bore wall, which coupling may be utilised to fix the tubing relative to the bore, both axially and rotationally, to facilitate subsequent operations, such as further reconfiguration or deformation of the tubing.

The bore profile may be formed in bore-lining tubing, such as casing or liner. The profile may be formed in the bore-lining tubing prior to the tubing being run into the bore. Alternatively, the profile may be formed after the bore ling tubing is located in the bore. The profile may be formed by any appropriate means, including a rotary profiling tool, as described in application GB 2346909, the disclosure of which is incorporated herein by reference. This permits the profile to be located to suit conditions in the bore.

BRIEF DESCRIPTION OF THE DRAWINGS

These and other aspects of the present invention will now be described, by way of example, with reference to the accompanying drawings, in which:

FIGS. 3 to 6 are schematic illustrations of steps in a method of anchoring tubing in a bore, in accordance with an embodiment of a first aspect of the present invention; and FIGS. 3*a*, 4*a* and 6*a* are sectional views on lines 3*a*—3*a*, 4*a*—4*a* and 6*a*—6*a* of FIGS. 3, 4 and 6, respectively.

DETAILED DESCRIPTION OF THE PREFERRED EMBODIMENT

Figure 1:
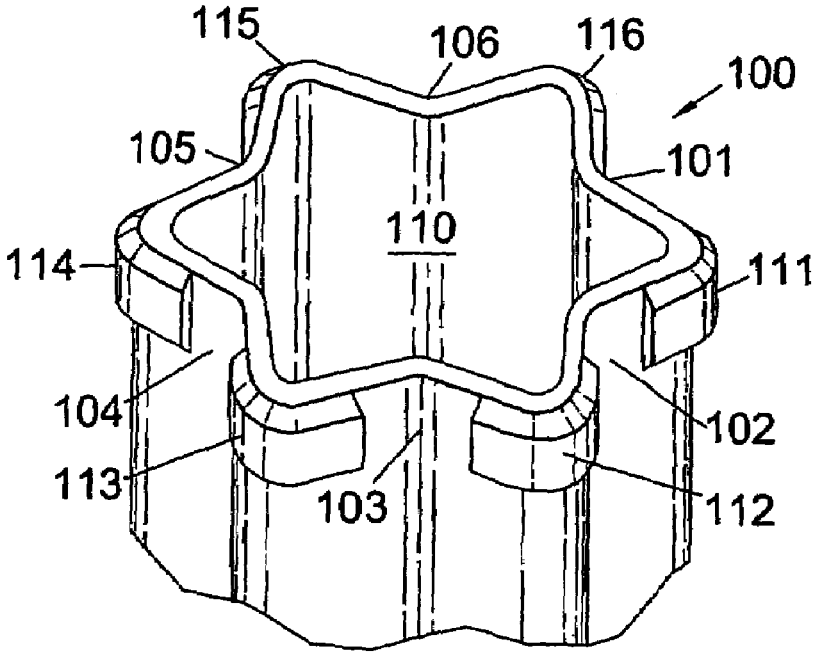
FIG. 1 is a perspective view of an expandable section of tubing incorporating a lip in accordance with an embodiment of the invention.

Referring firstly to FIG. 1, this shows a perspective view of an expandable section of bore-lining tubing, generally indicated by reference numeral 100, incorporating a lip, in accordance with a preferred embodiment of the invention. This section may be part of an otherwise circular section tubing of diameter slightly less than the bore with which the tubing is intended to be located.

The crinkled, expandable section 100 includes six concave wall portions, 101 to 106. Between each concave wall portion are lips 111 to 116, intended for engaging with cooperating recesses in a bore wall (not shown).

At least this crinkled section of the tubing 100 comprises an elastically deformable material and the lips 111 to 116 describes a diameter slightly greater than the bore internal diameter. The tubing is forced into the bore and the crinkled section 100 deforms to allow the lips 111 to 116 to pass down through the bore. When the lips 111 to 116 reach the complementary profile in the bore, the lips 111 to 116 will spring out to engage with the profile.

Figure 2:
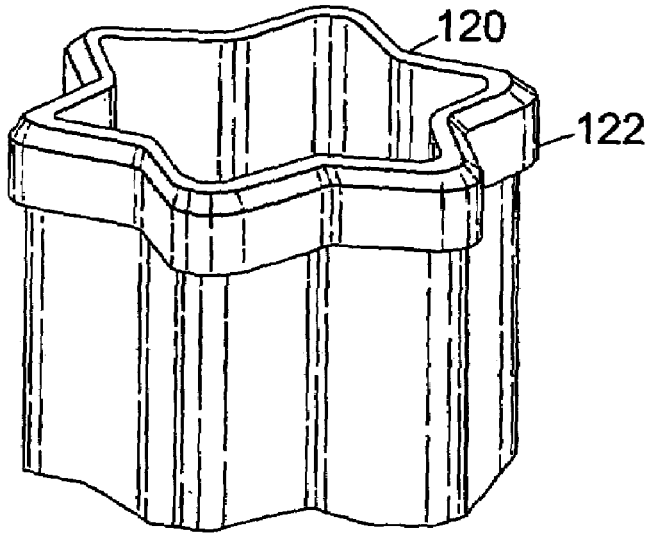
FIG. 2 is a perspective view of an expandable section of tubing incorporating a lip in accordance with an alternative embodiment of the invention.

FIG. 2 shows a perspective view of an expandable section of tubing 120 incorporating a lip, in accordance with an alternative embodiment of the invention. In this case the lip 122 is in the form of a continuous rib, for engaging with a cooperating channel in the bore.

Reference is now made to FIGS. 3 to 6 of the drawings, which illustrate steps in the method of anchoring tubing, according to a second aspect of the present invention, and subsequently cementing and sealing the tubing. Elements of the method described with reference to FIGS. 3 to 6, such as for cementing and sealing the tubing, are equally applicable to the method of anchoring described with reference to FIGS. 1 and 2. The tubing is in the form of liner 20, in the lower end of a drilled bore 22. In this embodiment the liner 20 describes a diameter less than the bore 22 diameter. In FIG. 3, the liner 20 is shown in the run-in position, with the upper end of the liner 20 overlapping the lower end of existing cemented casing 24. The remainder of the liner 20 is located in unlined, or open bore.

The liner 20 is coupled to a running string 26, formed of drill pipe, by means of co-operating profiles 28. Below the liner profile 28, which is located at the upper end of the liner 20, the liner wall defines a notch 30, the purpose and function of which will be described in due course.

Mounted to the lower end of the string 26, within the liner 20, is a running tool 31 and a rotary expansion tool 32. The expansion tool 32 comprises a hollow body 34 in fluid communication with the string 26, the body 34 accommodating three piston-mounted rollers 36. As will be described, supplying fluid at elevated pressure to the interior of the body 34 tends to urge the rollers 36 radially outwardly, and by then rotating the tool 32 within the liner 20 the internal and external diameters of the liner may be increased. A cement plug catcher 40 is mounted via shear pins to the lower end of the expansion tool 32.

A drillable cone and seal assembly 48 is initially located within a section of the liner 20*a* below the plug catcher 40, which liner section 20*a* has been formed to provide a corrugated or crinkled wall profile, as may be seen from FIG. 3*a* of the drawings. In addition the liner includes a radially projecting tubing lip 21, similar to the lips shown in FIGS. 1 and 2. The casing includes a profile 23, in the form of a radial recess. Other than the liner section 20*a*, the liner 20 is of a circular form and has an outer diameter slightly smaller than the inner diameter of the casing 24, to provide sufficient clearance for the liner 20 to be run in through the casing 24. However, the liner section 20*a* has been first shaped into a polygonal form in a forming die and the planar wall portions then further deformed to a concave form such that the outer diameter of the liner section 20*a* is described by six outer surface portions 50. The minimum inner diameter of the section 20*a* is defined by the midpoints of the concave wall portions 51.

The cone and seal assembly 48 comprises a hollow upper cone 52, and a reduced diameter tubular portion 56 extends from the cone 52 to a larger diameter stabiliser collar 58. The collar 58 has an external circumferential seal 54 for engaging the inner wall of the liner 20 and defines an internal ball seat 59. Initially, the assembly 48 is located in the liner 20 as illustrated in FIG. 3, that is with the cone 52 and collar 58 respectively located above and below the crinkled section 20*a*, and the tubular portion 56 extending through the section 20*a*.

The lower end of the liner 20 is provided with a drillable cement shoe 60.

In use, the liner 20 is run into the bore 22 to the position as illustrated in FIG. 3, with the liner profile 21 lining up with the casing profile 23. If desired, fluid may be circulated through the liner 20, and the liner 20 may be rotated within the bore 22 as the liner 20 is run in. Pre-flush fluid may then be pumped from surface down through the running string 26, followed by a ball 62 (FIG. 4) and a volume of cement 64. The ball 62 lands on the seat 59 and closes the throughbore defined by the collar 58. Fluid pressure then acts on the area defined by the seal 54, and urges the collar 58, and of course the remainder of the assembly 48, down through the crinkled section 20*a*. The diameter and profile of the cone 52 are selected such that the cone contacts the inner faces of the concave wall portions 51, which has the effect of moving the outer surface portions 50 radially outwards causing the liner profile 21 to engage with the casing profile 23. A pressure drop will be evident at surface when the cone 52 clears the lower end of the section 20*a*, and further pumping of cement 64 will continue to push the assembly 48 through the liner 20 until the collar 58 engages the shoe 60.

The gaps 76 (FIG. 4*a*) that remain between the casing inner wall and the polygonal liner section 20*a* allow for fluid circulation.

The volume of cement 64 is followed by a wiper plug 66 and water spacer 68. The plug 66 engages and shears out the plug catcher 40, which is then pushed through the liner 20 until the catcher 40 engages the cone 52. Prior to this, a pressure increase will have been applied to shear out the ball seat 59, such that the seat 59 and ball 62 land out within the float shoe 60, allowing the cement 64 to circulate into the annulus 70 between the liner 20 and the open bore 22.

Weight is then applied to the liner 20 to check the integrity of the thus-formed hanger, before releasing the running tool 31 from the liner 20.

Referring to FIG. 5, the expansion tool 32 is then lowered into the liner 20, which is now axially fixed relative to the casing 24 by the liner profile 21 being engaged with the tubing profile 23, until the tool 32 is located above the section 20*a* at a liner seal section 20*b*. Elevated fluid pressure applied through the string 26 to the tool 32 then acts to extend the rollers 36, such that rotation of the string 26 and the activated tool 32 will diametrically expand the liner section 20*b* into sealing contact with the casing 24. Fluid is then pumped through the running string 26 to circulate out cement residue, and the thus-formed hanger is then subject to a pressure test.

The expansion of the liner 20 is then continued over the notch 30, and the expansion at the notch causes the liner 20 to separate. The tool 32, and the short length of liner 20 above the notch 30, may then be pulled out of the bore on the running string 26, as shown in FIG. 6.

In other embodiments of the invention, a profiled liner section may be subject to expansion by a cone and seal assembly or the like while positioned within the lower end of the casing. The outer surface portions of the expanded liner section, if unrestrained by the surrounding casing, would assume a larger diameter. Accordingly, the restraint provided by the casing results in the liner section outer surface portions engaging the casing, allowing the liner to be hung from the casing while providing gaps between the liner and casing to permit fluid circulation.

What is claimed is:

1. A method of anchoring a tubing in a bore, the bore having an internal first diameter, and a bore profile, the method comprising:

providing the tubing having a section with outer surface portions defining a tubing profile, the outer surface portions having an outer diameter greater than the first diameter;

reconfiguring the outer surface portions to a smaller outer diameter;

axially translating the tubing relative to the bore to locate the tubing within the bore such that the tubing profile engages with the bore profile; and cementing the tubing in the bore.

2. The method of claim 1, wherein at least one of the tubing and the bore is formed from an elastically deformable material.

3. The method of claim 2, wherein the tubing is formed from an elastically deformable material.

4. The method of claim 3, wherein the tubing section is elastically deformed when moved into said bore.

5. The method of claim 2, wherein the bore is formed from an elastically deformable material.

6. The method of claim 2, comprising forming the tubing and the bore from an elastically deformable material.

7. The method of claim 1, comprising forming the tubing profile as at least one radially extending surface and the bore profile as at least one cooperating radially extending surface.

8. The method of claim 1, comprising forming the tubing profile as at least one radial projection and the bore profile as at least one radial recess.

9. The method of claim 8, comprising forming the tubing profile as a plurality of radial projections and the bore profile as a plurality of radial recesses.

10. The method of claim 1, comprising forming said tubing section by:

providing circular section tubing having an outer diameter at least as large as the first diameter;

reconfiguring portions of the initially circular section tubing to a generally planar form such that the tubing is then substantially polygonal, and then further reconfiguring the planar tubing portions to form convex tubing portions, located between outer surface portions, such that the tubing defines an outer diameter less than said first diameter.

11. The method of claim 1, comprising forming the tubing section by:

providing circular section tubing having an outer diameter at least as large as the first diameter, and forming at least one axially extending indent in the circular section tubing to create at least one convex wall portion such that the tubing defines an outer diameter less than said first diameter.

12. The method of claim 1, further comprising passing fluid between the reconfigured tubing section and the surrounding bore.

13. The method of claim 1, further comprising sealing at least a portion of the tubing in the bore.

14. The method of claim 13, comprising sealing said portion of the tubing in the bore by reconfiguring the tubing section to a form corresponding to the bore wall.

15. The method of claim 13, comprising sealing the portion of the tubing to the bore by configuring another section of the tubing to a form corresponding to the bore wall.

16. The method of claim 1, wherein the bore comprises an unlined drilled bore.

17. The method of claim 1, wherein the bore comprises a section of tubing-lined bore.

18. The method of claim 17, wherein the bore-lining tubing is substantially unexpandable.

19. The method of claim 1, further comprising providing a profile in the tubing for co-operating with a corresponding profile on a running string to allow the string to support the tubing as the tubing is being run into the bore.

20. The method of claim 19, further comprising providing the profile on an upper portion of the tubing, above a notch in the tubing, and subjecting the area of tubing including the notch to expansion utilising a rotary expander to part the tubing at the notch.

21. A method of anchoring tubing in a bore, the method comprising:

providing tubing having a section having outer surface portions defining a corrugated tubing profile, the outer surface portions configured to describe an outer diameter less than a first diameter;

forming a bore profile as at least one radial projection and the tubing profile as at least one radial recess;

locating the tubing within the bore having the bore profile; and reconfiguring the tubing section such that the tubing profile engages with the bore profile.

22. The method of claim 21, comprising reconfiguring the tubing section such that the tubing profile engages with the bore profile by applying a radially outwardly directed force to one or more convex wall portions to urge the outer surface portions radially outwards to assume a configuration in which the outer surface portions describe a diameter at least as large as the first diameter.

23. The method of claim 22, wherein the radially outwardly directed force is created by passing a tubing expander through the tubing.

24. The method of claim 23, wherein the tubing expander comprises an expansion cone.

25. The method of claim 23, wherein the tubing expander comprises a seal for sealingly engaging the bore, and further comprising utilising fluid pressure to drive the expander through the tubing section.

26. The method of claim 25, comprising providing the tubing expander in a first configuration in which fluid may pass through or around the expander, and then reconfiguring the expander to a second configuration in which the expander creates a barrier to fluid flow through the bore.

27. The method of claim 26, further comprising reconfiguring the expander to a third configuration in which fluid may again flow through or around the expander.

28. The method of claim 21, wherein the tubing section is reconfigured such that the outer surface portions engage with the bore by applying a radially outwardly directed force to at least a portion of the tubing section.

29. The method of claim 21, comprising forming the bore profile as a plurality of radial projections and the tubing profile as a plurality of radial recesses.

30. The method of claim 21, comprising forming the at least one radial projection as a circumferential rib and the at least one radial recess as a circumferential channel.

31. An apparatus for anchoring a tubing in a bore, the bore having an internal diameter equal to a first diameter and a bore profile, the apparatus comprising:

a section of the tubing with a non-circular wall, the section having an outer surface portion, part of the outer surface portion defining a tubing profile, the section configured such that the outer surface portion describes an outer diameter greater than the first diameter prior to running the tubing into the bore, the tubing profile includes at least one radial projection whereby the at least one radial projection is a circumferential rib and the bore profile includes at least one radial recess whereby the at least one radial recess is a circumferential channel; and a running tool for running the tubing into the bore and then locating the tubing section in the bore.

32. The apparatus of claim 31, wherein at least one of the tubing and the bore is formed from an elastically deformable material.

33. The apparatus of claim 32, wherein the tubing is formed from an elastically deformable material.

34. The apparatus of claim 33, wherein the tubing section is elastically deformed when moved into said bore.

35. The apparatus of claim 32, wherein the bore is formed from an elastically deformable material.

36. The apparatus of claim 32, comprising forming the tubing and the bore from an elastically deformable material.

37. The apparatus of claim 31, wherein the apparatus further comprises an expander, for expanding a section of the tubing into sealing contact with the bore wall.

38. The apparatus of claim 37, wherein the expander is a rotary expander.

39. The apparatus of claim 31, wherein the tubing profile is at least one radially extending surface and the bore profile is at least one cooperating radially extending surface.

40. The apparatus of claim 31, wherein the tubing profile is a plurality of radial projections and the bore profile is a plurality of radial recesses.

41. The apparatus of claim 31, wherein the tubing section comprises circumferentially spaced outer surface portions.

42. The apparatus of claim 41, wherein the outer surface portions are regularly spaced around the circumference of the tubing.

43. The apparatus of claim 31, wherein the outer surface portion is defined by a substantially continuous arc or segment.

44. The apparatus of claim 31, wherein one or more convex wall portions are located between outer surface portions.

45. The apparatus of claim 31, wherein a section of the tubing includes a seal member.

46. The apparatus of claim 31, in combination with bore-lining tubing of said first diameter.

47. The apparatus of claim 31, wherein the tubing includes an internal profile for engaging the running tool.

48. The apparatus of claim 47, wherein the internal profile is provided on an upper portion of the tubing, above a notch in the tubing.

49. An apparatus for anchoring a tubing in a section of a bore of internal diameter equal to a first diameter, the bore defining a bore profile, the apparatus comprising:

a section of the tubing with a non-circular wall, the section having an outer surface portion, part of the outer surface portion defining a tubing profile, the section configured such that the outer surface portion describes an outer diameter less than the first diameter;

a running tool for running the tubing into the bore and then locating the tubing section in the bore; and a first expander for diametrically expanding the tubing section wall such that the tubing profile engages with the bore profile, wherein the first expander comprises an expansion cone and the second expander is a rotary expander.

50. The apparatus of claim 49, wherein the first expander comprises a seal for sealingly engaging a wall of the first tubing, such that fluid pressure may be utilised to drive the expander through the tubing.

51. The apparatus of claim 49, wherein the first expander has a first configuration in which fluid may pass through or around the expander, and a second configuration in which the expander creates a barrier to fluid flow.

52. The apparatus of claim 49, wherein the apparatus further comprises a second expander, for expanding a section of the tubing into sealing contact with the bore wall.

53. An expandable downhole tubing including a tubing section with a non-circular wall having a first diameter, the wall having an outer surface portion, part of the outer surface portion defining a tubing profile comprising at least one radial projection, whereby the at least one radial projection comprises a circumferential rib, the wall configured such that the outer surface portion describes a run-in diameter less than said first diameter, the tubing section being diametrically expandable such that said outer surface portion describes a diameter at least as large as said first diameter.

54. The expandable downhole tubing of claim 53, wherein the tubing profile defines at least one radially extending surface.

55. The expandable downhole tubing of claim 54, wherein the tubing profile comprises a plurality of radial projections.

56. The expandable downhole tubing of claim 53, wherein the tubing profile comprises at least one radial recess.

57. The expandable downhole tubing of claim 56, wherein the tubing profile comprises a plurality of radial recesses.

58. The expandable downhole tubing of claim 56, wherein the at least one radial recess comprises a circumferential channel.

59. The expandable downhole tubing of claim 53, wherein a plurality of outer surface portions are regularly spaced around the circumference of the tubing.

60. The expandable downhole tubing of claim 53, wherein the outer surface portion is defined by a substantially continuous arc or segment.

61. The expandable downhole tubing of claim 53, wherein one or more convex wall portions are located between outer surface portions.

62. The expandable downhole tubing of claim 53, wherein one or more convex wall portions are located between outer surface portions.

63. A method of forming tubing having a section configured to provide outer surface portions describing an outer diameter less than a selected first diameter, comprising:

providing circular section tubing having an outer surface, part of the outer surface defining a profile, the tubing having an outer diameter at least as large as the first diameter;

reconfiguring portions of the initially circular tubing section to a generally planar form such that the tubing section is then substantially polygonal, and then further reconfiguring the planar tubing section portions to form convex tubing portions, located between outer surface portions, whereby the profile includes at least one radial projection whereby the at least one radial protection Is a continuous rib.

64. A method of forming a tubing having a section with an outer diameter less than a first diameter, comprising:

providing the tubing with a circular section and a profile, the profile having an outer diameter at least as large as the first diameter, and forming at least one axially extending indent in the circular tubing section and the profile to create at least one convex tubing portion such that the profile defines an outer diameter less than said first diameter and the profile includes at least one radial projection whereby the at least one radial projection is a continuous rib.

65. A method of anchoring tubing in a bore, the method comprising:

providing tubing having at least a section having outer surface portions, part of the outer surface portions defining a crinkled profile, the section configured such that the outer surface portions describe an outer diameter less than a first diameter;

locating the tubing within a bore having an internal surface, part of the internal surface defining a profile, the bore having an internal diameter corresponding to said first diameter; and reconfiguring said section such that said outer surface portions are biased to describe an outer diameter greater than said first diameter but are restrained to said first diameter by said bore, and such that said tubing profile engages the bore profile.

66. The method of claim 65, wherein the profile includes at least one radial recess.

67. The method of claim 66, wherein the at least one radial recess is a circumferential channel.

68. An apparatus for use in anchoring tubing in a section of a bore of internal diameter equal to a first diameter, the bore defining a bore profile, the apparatus comprising:

tubing including a section with a non-circular wall, the wall having an outer surface portion, part of the outer surface portion defining a tubing profile, the wall configured such that the outer surface portion describes an outer diameter greater than the first diameter, wherein the tubing comprises a tubing hanger; and means for engaging a running tool for running the tubing into the bore and then locating the tubing section in the bore.

69. A method of anchoring a deformed tubing in a profile in a wellbore, the deformed tubing having a first diameter, the method comprising:

reconfiguring the deformed tubing to a second smaller diameter;

positioning the deformed tubing in the profile, the profile having at least one radial recess wherein the at least one radial recess is a circumferential channel; and expanding the deformed tubing into engagement with the profile.

70. A method of anchoring a tubing in a bore, the bore having an internal first diameter, and a bore profile, the method comprising:

providing the tubing having a section with outer surface portions defining a tubing profile, the outer surface portions having an outer diameter greater than the first diameter;

forming the tubing profile with at least one radial projection whereby the at least one radial projection is a circumferential rib and forming the bore profile with at least one radial recess whereby the at least one radial recess is a circumferential channel;

reconfiguring the outer surface portions to a smaller outer diameter; and axially translating the tubing relative to the bore to locate the tubing within the bore such that the tubing profile engages with the bore profile.

71. An apparatus for anchoring a tubing in a bore, the bore having an internal diameter equal to a first diameter and a bore profile, the apparatus comprising:

a section of the tubing with a non-circular wall, the section having an outer surface portion, part of the outer surface portion defining a tubing profile, the section configured such that the outer surface portion describes an outer diameter greater than the first diameter prior to running the tubing into the bore, wherein the bore profile is at least one radial projection and the tubing profile is at least one radial recess; and a running tool for running the tubing into the bore and then locating the tubing section in the bore.

72. The apparatus of claim 71, wherein the bore profile is a plurality of radial projections and the tubing profile is a plurality of radial recesses.

73. The apparatus of claim 71, wherein the at least one radial projection is a circumferential rib and the at least one radial recess is a circumferential channel.

* * * * *